US007042401B2

(12) United States Patent
Park et al.

(10) Patent No.: US 7,042,401 B2
(45) Date of Patent: May 9, 2006

(54) TRAPEZOID ULTRA WIDE BAND PATCH ANTENNA

(75) Inventors: Jong-Kweon Park, Daejon (KR); Bong-Hyuk Park, Daejon (KR); Seung-Sik Lee, Daejon (KR); Jae-Young Kim, Gyeonggi-Do (KR); Sangsung Choi, Daejon (KR); Seoung-Hun Lee, Daejon (KR); Jung-Nam Lee, Daejon (KR)

(73) Assignee: Electronics and Telecommunications Research Institute, (KR)

( * ) Notice: Subject to any disclaimer, the term of this patent is extended or adjusted under 35 U.S.C. 154(b) by 0 days.

(21) Appl. No.: 11/024,568

(22) Filed: Dec. 28, 2004

(65) Prior Publication Data

US 2006/0066487 A1 Mar. 30, 2006

(30) Foreign Application Priority Data

Sep. 30, 2004 (KR) ..... 10-2004-0077880

(51) Int. Cl.
*H01Q 1/38* (2006.01)

(52) U.S. Cl. ..... 343/700 MS

(58) Field of Classification Search ..... 343/700 MS
See application file for complete search history.

(56) References Cited

U.S. PATENT DOCUMENTS 5,530,637 A * 6/1996 Fujita et al. ..... 363/126
5,600,331 A * 2/1997 Buralli ..... 343/700 MS
5,828,340 A 10/1998 Johnson
6,034,637 A * 3/2000 McCoy et al. ..... 343/700 MS
6,150,981 A * 11/2000 Suguro et al. ..... 343/700 MS
6,339,402 B1 * 1/2002 McKivergan ..... 343/702
6,573,866 B1 6/2003 Chen
2005/0162335 A1 * 7/2005 Ishii ..... 343/908

FOREIGN PATENT DOCUMENTS

KR 1020030054845 A 7/2003
KR 1020040052899 A 6/2004

OTHER PUBLICATIONS

Project: IEEE P802.15 Working Froup for Wireless Personal Area Networks (WPANS), 13 pages.
The Design of the Trapezoid Ultra-Wideband Antenna using CPW-Fed, 7 pages.

* cited by examiner

*Primary Examiner*—Tho Phan
(74) *Attorney, Agent, or Firm*—Blakely Sokoloff Taylor & Zafman

(57) ABSTRACT

A micro-miniature, light weighted and low cost trapezoid ultra wide antenna having an ultra wide band characteristics and a notch characteristic in 5 GHz WLAN band (5.15–5.35 GHz) is disclosed. The trapezoid ultra wide antenna includes: a dielectric substrate; a trapezoid shaped patch formed at an upper end of a middle line on an upper side of the dielectric substrate; a feeding line formed at a bottom end of the middle line on the upper side of the dielectric substrate for feeding electric power to the trapezoid shaped patch; a matching stub formed between the trapezoid shaped patch and the feeding line for impedance matching between the trapezoid shaped patch and the feeding line; and a ground formed at a side of the feeding line on the upper side of the dielectric substrate.

3 Claims, 11 Drawing Sheets

TRAPEZOID ULTRA WIDE BAND PATCH ANTENNA

FIELD OF THE INVENTION

The present invention relates to a trapezoid ultra wide band patch antenna; and, more particularly, to a coplanar waveguide (CPW)-fed micro-miniature ultra wide band patch antenna using a trapezoid shaped patch.

DESCRIPTION OF RELATED ARTS

An ultra wide band (UWB) communication system is a wireless communication technology developed by U.S. Department of Defense for a military purpose at 1960s. The UWB communication system provides fast transmission speed i.e., 500 Mbps to 1 Gbps, which is 10 times faster than a transmission speed of wireless local area network (WLAN) standard, IEEE 802.11a (54 Mbps). Also, the UWB communication system uses less electric power because the UWB communication systems use 10 s GHz of ultra wide frequency band.

An ultra wide band (UWB) antenna is one of major factors of the UWB communication system. The UWB antenna requires a non-directional characteristic for all frequencies in target band, a small phase variation, no distortion of signal for pulse communication, a constant attenuation in a target band, a small size for mobility, and less cost for manufacturing.

Also, the UWB communication system uses 3.1 to 10.6 GHz of frequency bands which include a frequency band of WLAN (5.15 to 5.35 GHz). Therefore, the UWB communication system may generate an interference with the WLAN frequency band. Accordingly, the UWB antenna must have a notch characteristic at 5.15 to 5.35 GHz in order to prevent the UWB antenna to transmit/receive signals of WLAN frequency band.

FIG. 1 is a diagram illustrating a monopole antenna having a curved T shape patch as a conventional UWB antenna.

As shown in FIG. 1, the monopole antenna includes a substrate 20, a curved T shape patch 10 arranged at top of the substrate 20 and a short plate 40 arranged at bottom of the substrate 20. The curved T shape patch 10 has complicated shape and a plurality of via holes 30 are formed on the substrate 20 for the short plate 40. The via holes 30 may cause loss of feeding electric power and the monopole antenna is very difficult to be manufactured because of the complicated shape of the curved T shape patch 10.

Also, the monopole antenna does not include an element for providing the notch characteristics. Accordingly, the monopole antenna may generate interference with the WLAN frequency bands (5.15 to 5.35 GHz).

SUMMARY OF THE INVENTION

It is, therefore, an object of the present invention to provide a micro-miniature, light weighted and low cost ultra wide antenna having an ultra wide band characteristics and a notch characteristics in 5 GHz WLAN band (5.15–5.35 GHz) by using a trapezoid patch, a matching stub, a CPW feed type and a rectangular slot.

In accordance with an aspect of the present invention, there is also provided a trapezoid shaped ultra wide patch antenna, including: a dielectric substrate; a trapezoid shaped patch formed at an upper end of a middle line on an upper side of the dielectric substrate; a feeding line formed at a bottom end of the middle line on the upper side of the dielectric substrate for feeding electric power to the trapezoid shaped patch; a matching stub formed between the trapezoid shaped patch and the feeding line for impedance matching between the trapezoid shaped patch and the feeding line; and a ground formed at a side of the feeding line on the upper side of the dielectric substrate.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, a trapezoid ultra wide band patch antenna in accordance with a preferred embodiment of the present invention will be described in more detail with reference to the accompanying drawings.

Figure 1:
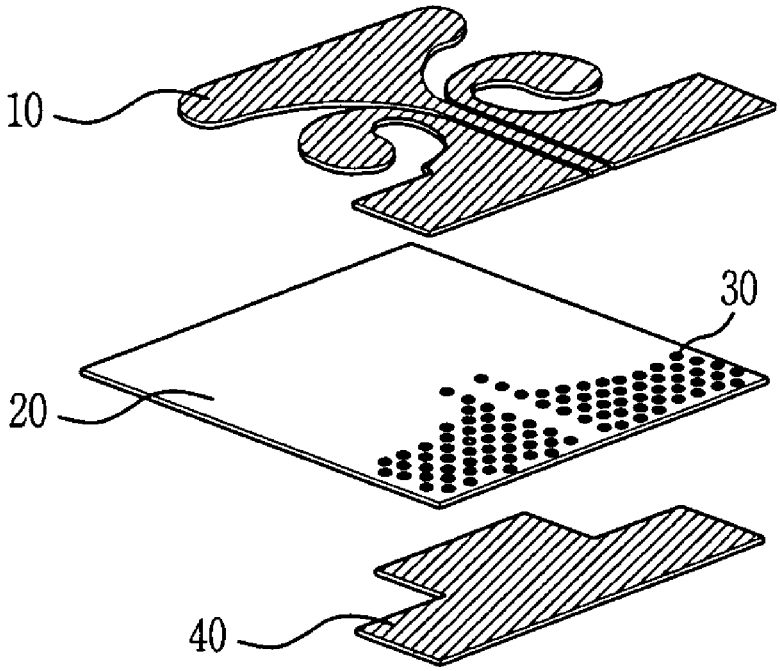
FIG. 1 (PRIOR ART)
FIG. 1 is a diagram illustrating a monopole antenna having a curved T shape patch as a conventional UWB antenna.
Figure 2:
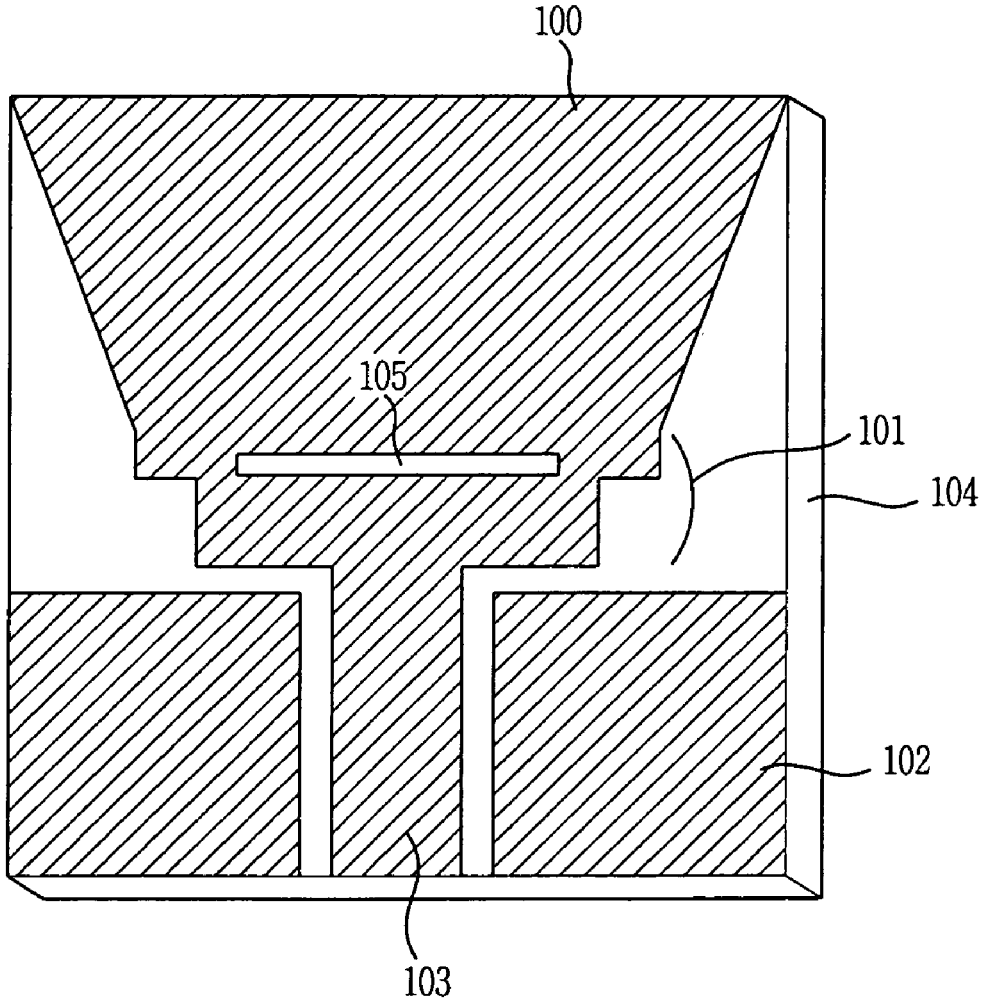
FIG. 2 is a diagram illustrating a trapezoid ultra wide band patch antenna in accordance with a preferred embodiment of the present invention.

FIG. 2 is a diagram illustrating a trapezoid ultra wide band patch antenna in accordance with a preferred embodiment of the present invention.

As shown in FIG. 2, the trapezoid ultra wide band patch antenna includes a trapezoid patch 100 having a rectangular slot 105, a matching stub 101, a ground 102, a coplanar waveguide (CPW) feeding line 103 and a dielectric substrate 104. That is, the trapezoid ultra wide band patch antenna is embodied by forming the trapezoid patch 100 on the dielectric substrate 104 and using the CPW feeding line 103 and the matching stub 101. The preferred embodiment of the present invention is embodied by using the trapezoid shape patch 100 having a size of 30×18 $mm^2$, the ground 102 having a size of 13.35×10 $mm^2$ and the dielectric substrate 104 having a size of 30×30 $mm_2$.

Also, the dielectric substrate 104 has a height of 0.762 mm and a TTM 4 manufactured by "Rogers" is used as the dielectric substrate 104, where the TTM 4 has a 4.5 of a dielectric constant and 0.002 of loss tangent. A CPW feeding structure formed on a back side of the dielectric substrate 104 without a ground for providing an ultra wide band characteristic.

The trapezoid patch 100 has a shape of trapezoid. The shape of trapezoid helps to flow electric smoother comparing to a shape of rectangle. Accordingly, the trapezoid patch 100 has wide band characteristics wider than a patch having a rectangle shape.

The matching stub 101 is used for impedance matching between the CPW feeding line 103 and the trapezoid patch 100. Therefore, by using the matching stub 101, the ultra wide band characteristic is provided and a narrow band characteristic of a patch antenna is complemented.

Meanwhile, the ultra wide band characteristic can be implemented to a patch antenna by controlling a size of the ground 102. That is, by increasing a height of the ground 102 to be closed to the trapezoid patch 100, a voltage standing wave ratio (VSWR) of the antenna becomes decreased. In contrary, the VSWR becomes increased by decreasing the height of the ground 102 to be away from the trapezoid patch 100.

Furthermore, the ground 102 is arranged at front of the antenna where the trapezoid patch 100 is formed in order to decrease loss of feeding electric power. Accordingly, a serial/parallel circuit having a passive element and an active element can be implemented without using via holes. Therefore, a surface of the antenna may be effectively used comparing to a conventional antenna.

Meanwhile, the rectangular patch 105 is formed on the trapezoid patch 100 for providing the notch characteristic at 5 GHz WLAN band (5.15 to 5.35 GHz). A size of the notch slot 105 is 18×0.15 $mm^2$.

Figure 3:
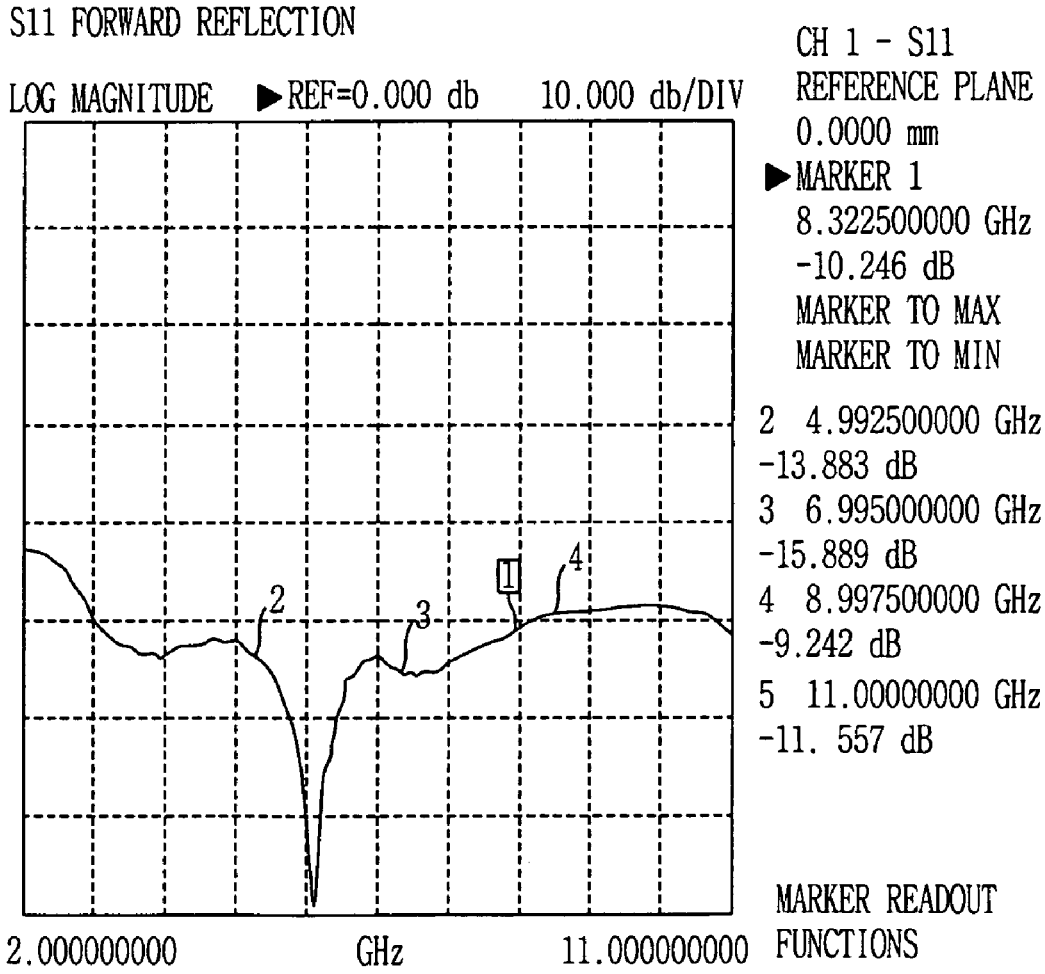
FIG. 3 is a graph showing a reflection loss of a trapezoid ultra wide band patch antenna in FIG. 2.

FIG. 3 is a graph showing a reflection loss of a trapezoid ultra wide band patch antenna in FIG. 2. The graph shows the reflection loss measured by a network analyzer.

As shown in FIG. 3, the trapezoid ultra wide band patch antenna of the present invention has 2.7 to 8.0 GHz of bandwidth at below −10 dB where the VSWR is 2:1. A fractional bandwidth of the trapezoid ultra wide band patch antenna is 100%.

Figure 4:
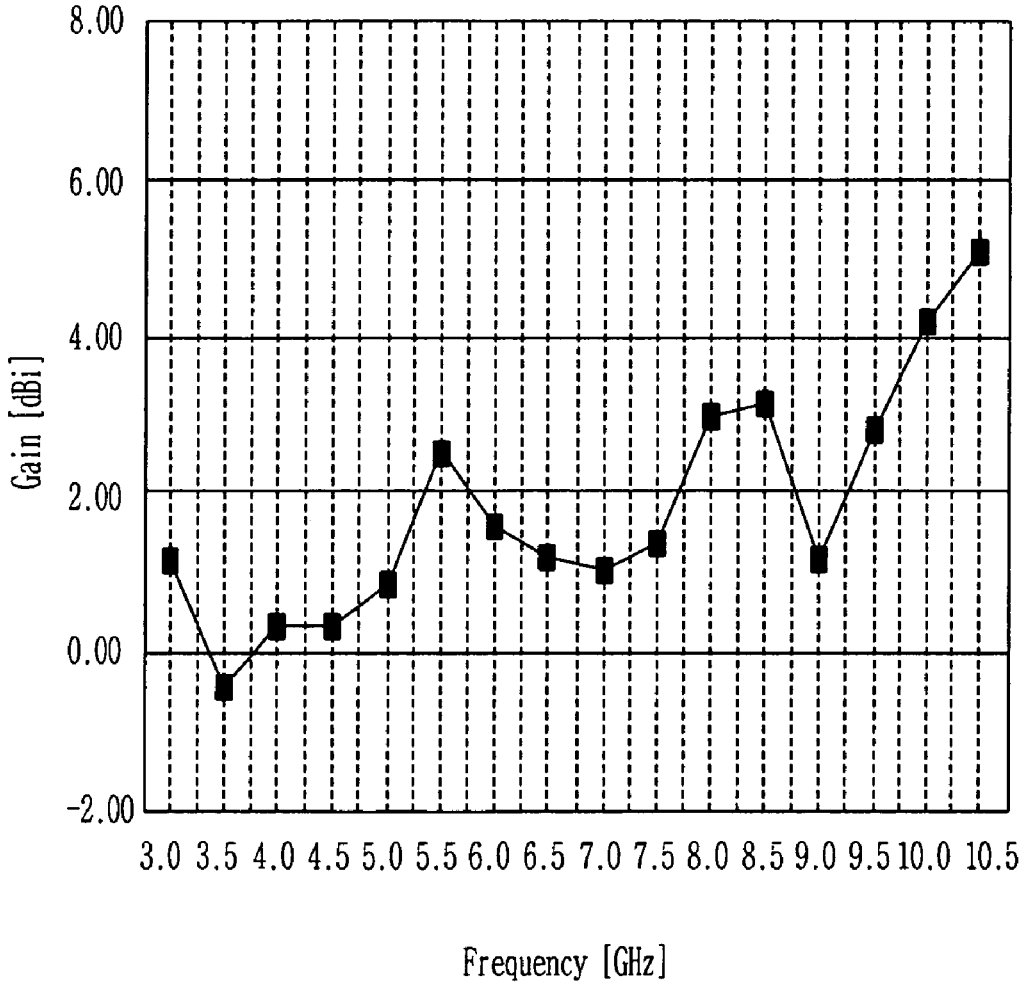
FIG. 4 is a graph showing a gain of a trapezoid ultra wide band patch antenna of the present invention.

FIG. 4 is a graph showing a gain of a trapezoid ultra wide band patch antenna of the present invention.

As shown in FIG. 4, a variation of gain in a target band is 3 dBi in the trapezoid ultra wide band patch antenna in accordance with a preferred embodiment of the present invention.

Figure 5:
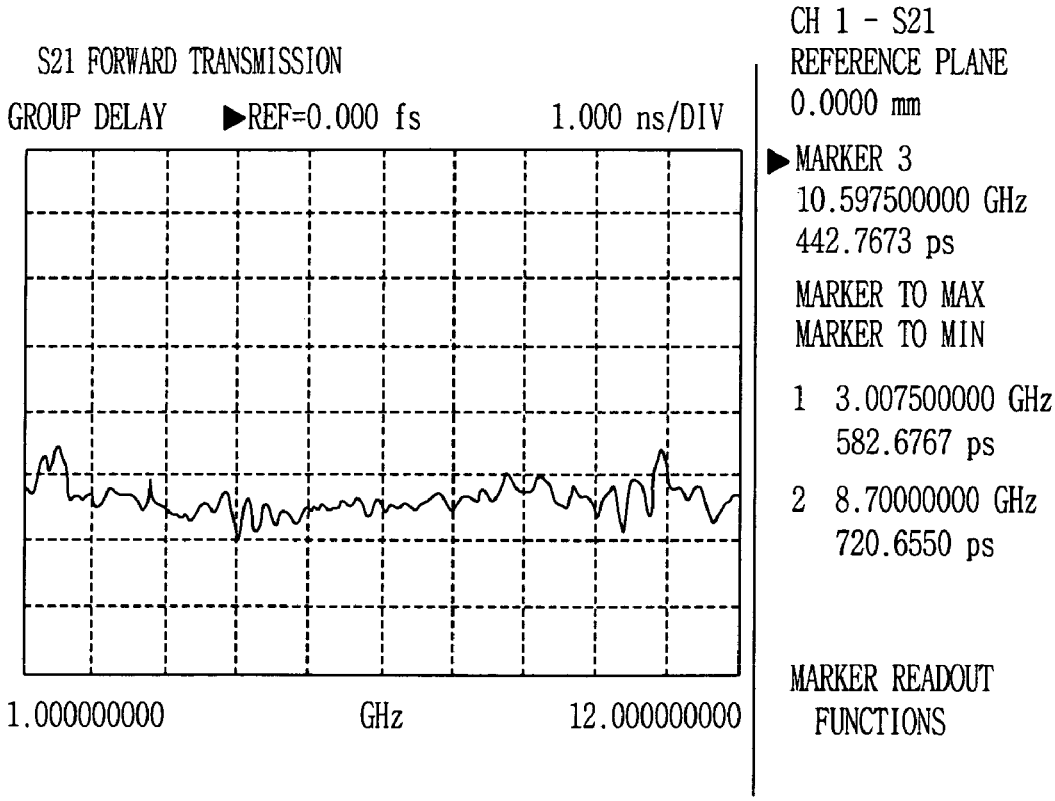
FIG. 5 is a graph showing a group delay of a trapezoid ultra wide band patch antenna of the present invention.

FIG. 5 is a graph showing a group delay of a trapezoid ultra wide band patch antenna of the present invention.

For measuring a group delay of a trapezoid ultra wide band patch antenna of the present invention, two of the trapezoid ultra wide band antennas are manufactured and one of the antennas is connected to a port 1 of a network analyzer and other antenna is connected to a port 2 of the network analyzer. And then, the group delay of S21 is measured by separating two trapezoid ultra wide band antennas within about 15 cm of a gap.

As shown in FIG. 5, the trapezoid ultra wide band patch antenna has ins of a variation of the group delay in the target band.

Figure 6:
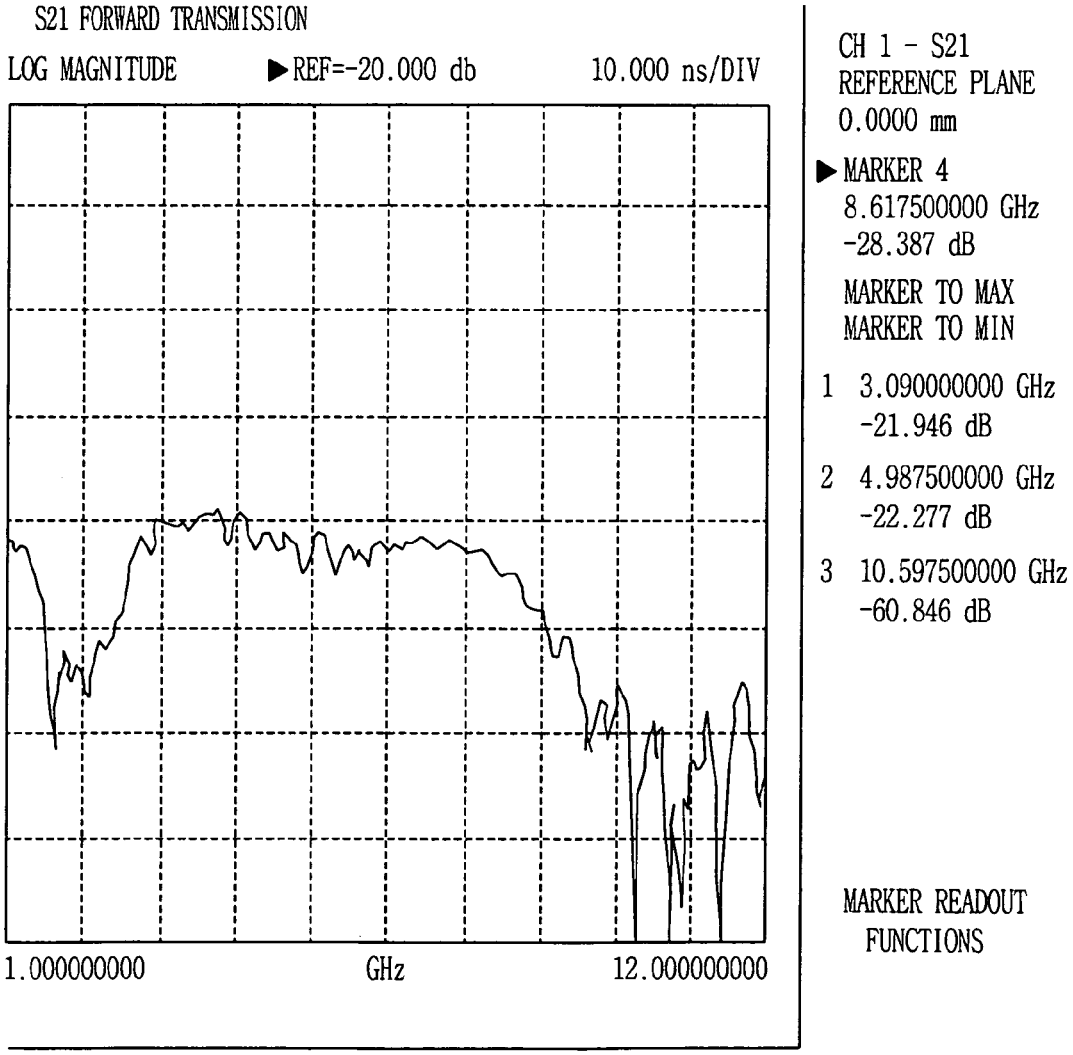
FIG. 6 is a graph showing a damping ratio of a trapezoid ultra wide band patch antenna of the present invention.

FIG. 6 is a graph showing a damping ratio of a trapezoid ultra wide band patch antenna of the present invention.

For measuring a damping ratio of a trapezoid ultra wide band patch antenna of the present invention, two of the trapezoid ultra wide band antennas are manufactured and one of the antennas is connected to a port 1 of a network analyzer and other antenna is connected to a port 2 of the network analyzer. And then, the damping ratio of S21 is measured by separating two trapezoid ultra wide band antennas within about 15 cm of a gap.

The UWB communication system requires constant damping ratio of S21 for a pulse communication. As shown in FIG. 6, the trapezoid ultra wide band patch antenna has a constant damping ratio (−20 dB).

Figure 7:
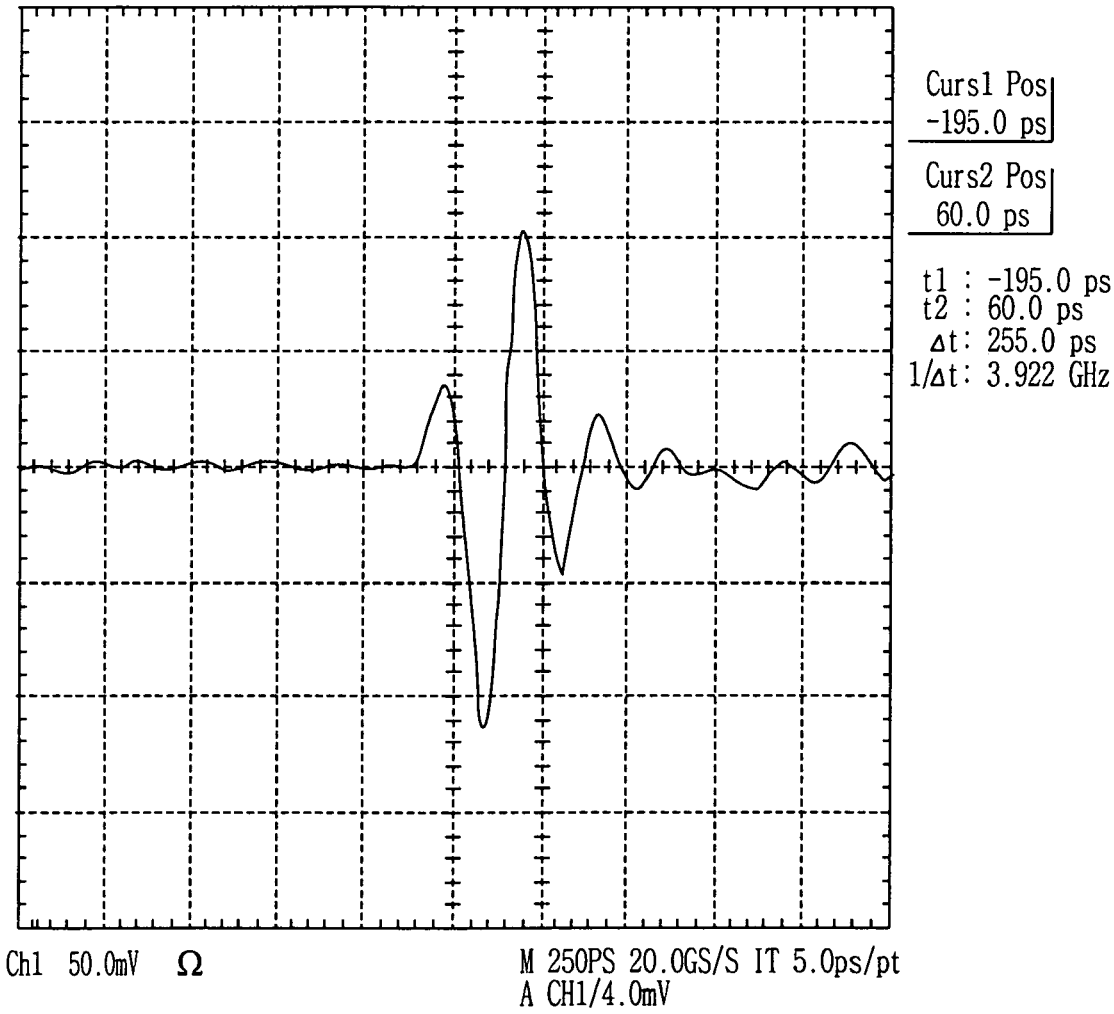
FIG. 7 is a graph showing a wave form of a transmission signal generated for measuring a transmitting/receiving characteristic of a trapezoid ultra wide band patch antenna of the present invention.

FIG. 7 is a graph showing a wave form of a transmission signal generated for measuring a transmitting/receiving characteristic of a trapezoid ultra wide band patch antenna of the present invention. And, FIG. 8 is a graph showing a wave form of a receiving signal received from a trapezoid ultra wide band antenna of the present invention, where the receiving signal is correspondence to the transmission signal transmitted from the trapezoid ultra wide band antenna of the present invention.

For measuring the transmitting/receiving characteristics of the trapezoid ultra wide band patch antenna of the present invention, two of trapezoid ultra wide band patch antennas are manufactured in accordance with a preferred embodiment of the present invention. One of antennas is connected to a pulse generator and operated as a transmitting antenna in order to transmit a pulse signal shown in FIG. 7. Other antenna is operated as a receiving antenna in order to receive the pulse signal transmitted from the transmitting antenna. A digital oscilloscope is used for measuring a wave form of the receiving signal.

Two antennas are separated within 15 cm of a gap and a source signal of the pulse generator is a pulse signal having 4 GHz of center frequency and 255 ps of pulse width.

Figure 8:
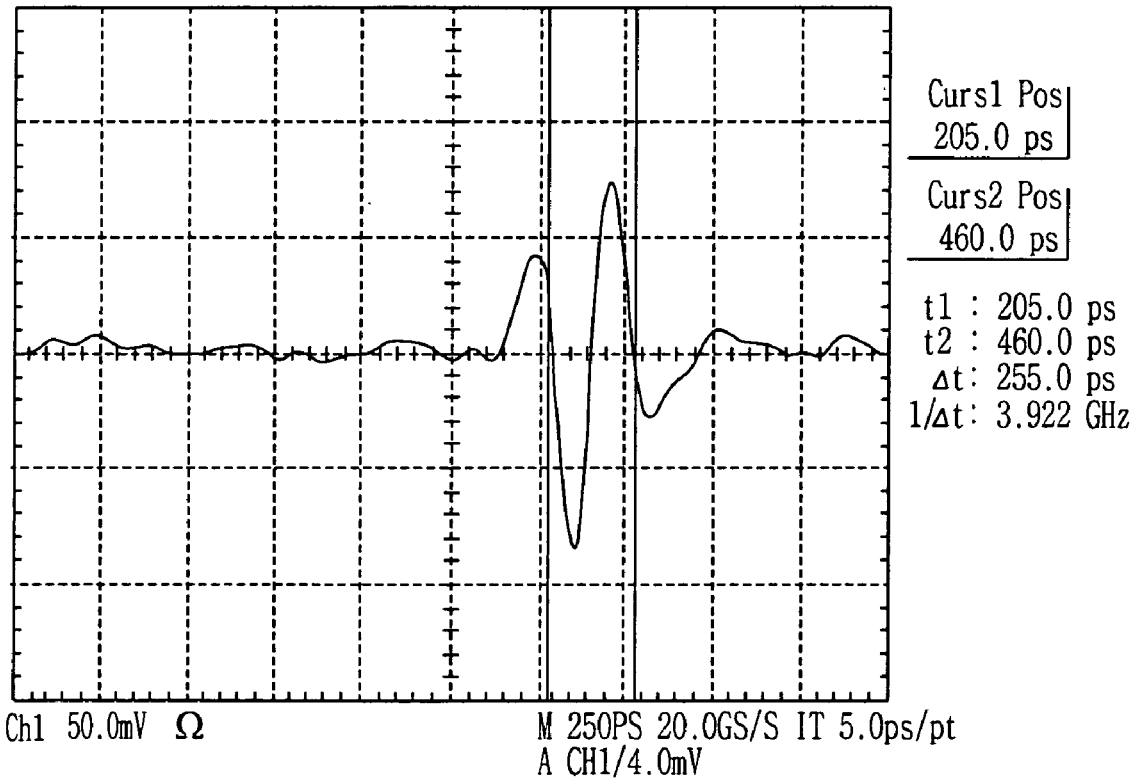
FIG. 8 is a graph showing a wave form of a receiving signal received from a trapezoid ultra wide band antenna of the present invention.

As shown in FIGS. 7 and 8, two wave forms shown in FIGS. 7 and 8 are almost identical and are undistorted. Only, a level of signal is decreased.

Figure 9A:
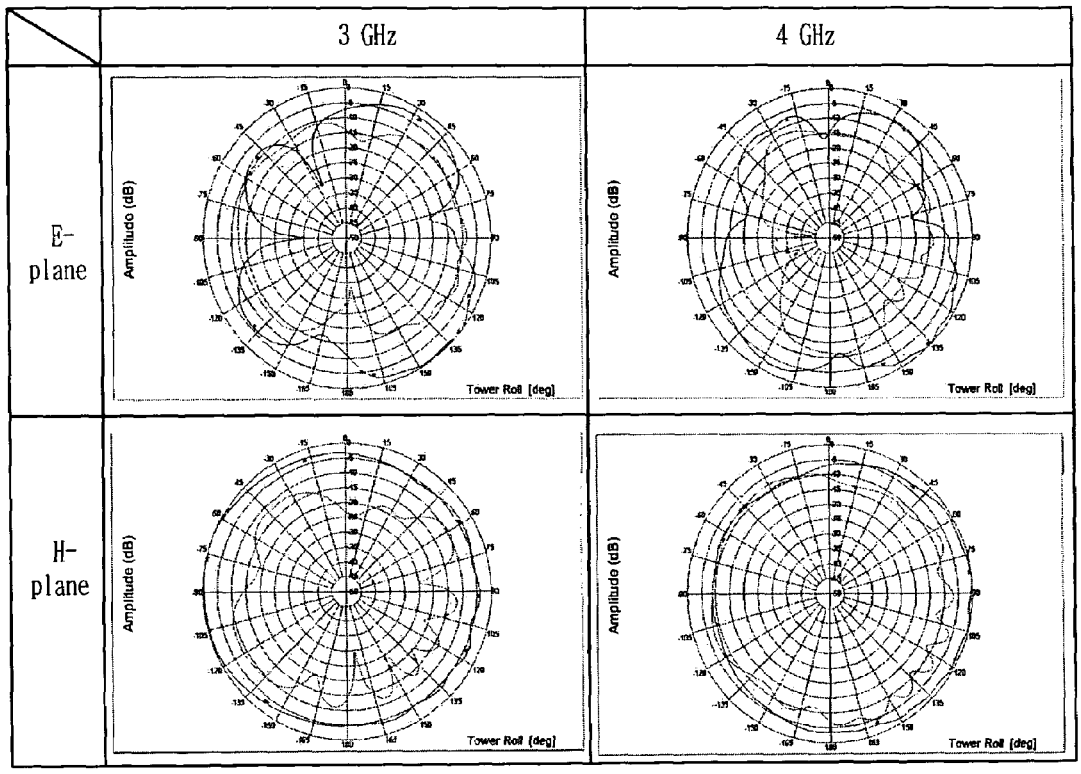
FIGS. 9A and 9B are graphs showing a radiation pattern of a trapezoid ultra wide band patch antenna of FIG. 2.
Figure 9B:
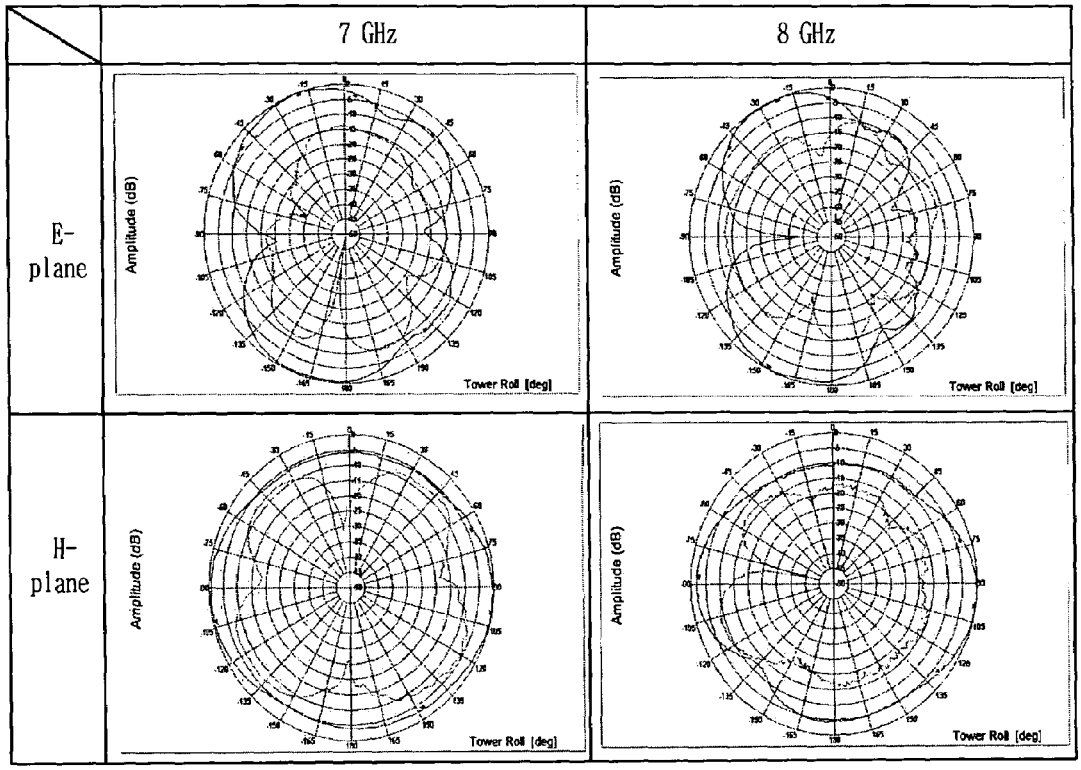

FIGS. 9A and 9B are graphs showing a radiation pattern of a trapezoid ultra wide band patch antenna of FIG. 2.

As shown in FIGS. 9A and 9B, the radiation pattern of the trapezoid ultra wide band patch antenna has omni-directional characteristic at a H-plane (XZ-plane). And, the radiation pattern of the trapezoid ultra wide band patch antenna in an E-plane is similar to a radiation pattern similar of a dipole antenna characteristic.

Figure 10:
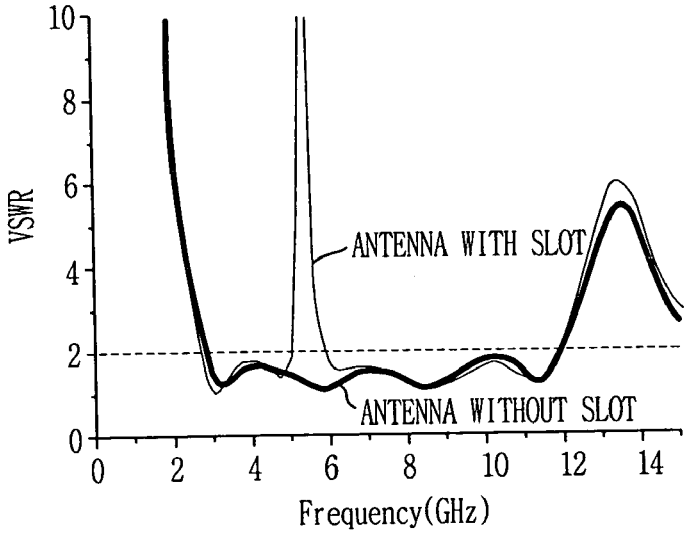
FIG. 10 is a graph showing a variation of voltage standing wave ratio (VSWR) between a trapezoid ultra wide band patch antenna with a rectangular slot and a trapezoid ultra wide band patch antenna without a rectangular slot in accordance with a preferred embodiment of the present invention.

FIG. 10 is a graph showing a variation of voltage standing wave ratio (VSWR) between a trapezoid ultra wide band patch antenna with a rectangular slot and a trapezoid ultra wide band patch antenna without a rectangular slot in accordance with a preferred embodiment of the present invention.

As shown in FIG. 10, the trapezoid ultra wide band patch antenna provides the notch characteristics at 5 GHz WLAN band (5.15 to 5.35 GHz) by forming the rectangular slot 105 on the trapezoid patch 100.

Figure 11:
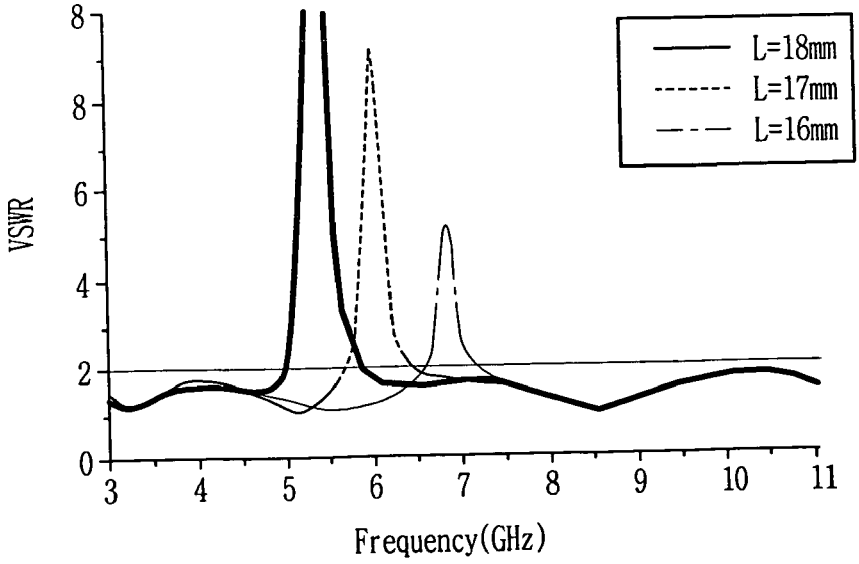
FIG. 11 is a graph showing a variation of voltage standing wave ration (VSWR) among three trapezoid ultra wide band patch antenna having different size of a rectangular slot in accordance with a preferred embodiment of the present invention.

FIG. 11 is a graph showing a variation of voltage standing wave ration (VSWR) among three trapezoid ultra wide band patch antenna having different size of a rectangular slot in accordance with a preferred embodiment of the present invention.

As shown in FIG. 11, a location of notch is varied according to the lengths of the rectangular slots 18 mm, 17 mm and 16 mm.

That is, the trapezoid ultra wide band patch antenna can provide desired notch characteristics at target band by controlling the length of the rectangular slot 105.

As mentioned above, in accordance with the preferred embodiment of the present invention, a micro-miniature and light weighted UWB antenna can be embodied by using the trapezoid shaped patch, the matching stub and the CPW feeding line.

Also, an UWB antenna can be easily and cost-effectively manufactured by using the trapezoid shaped patch, the matching stub and the CPW feeding line and the UWB antenna can be implemented to the UWB communication system.

Furthermore, by using the rectangular slot, the present invention can provide the notch characteristics in 5 GHz WLAN band (5.15 to 5.35 GHz).

The present application contains subject matter related to Korean patent application No. 10-2004-0077880, filed in the Korean patent office on Sep. 30, 2004, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. A trapezoid shaped ultra wide patch antenna, comprising:

a dielectric substrate;

a trapezoid shaped patch formed at an upper end of a middle line on an upper side of the dielectric substrate;

a feeding means formed at a bottom end of the middle line on the upper side of the dielectric substrate for feeding electric power to the trapezoid shaped patch;

a matching means formed between the trapezoid shaped patch and the feeding means for impedance matching between the trapezoid shaped patch and the feeding means; and a ground means formed at a side of the feeding means on the upper side of the dielectric substrate.

2. The trapezoid shaped ultra wide patch antenna as recited in claim 1, further comprising:

a slot formed on a bottom of the trapezoid shaped patch for providing a notch characteristic in a predetermined frequency band.

3. The trapezoid shaped ultra wide patch antenna as recited in claim 2, wherein the feeding means uses a coplanar waveguide (CPW) feeding type.

* * * * *